US006341399B2

(12) United States Patent
Method

(10) Patent No.: US 6,341,399 B2
(45) Date of Patent: Jan. 29, 2002

(54) POOL CUE MULTI-FUNCTION TIP TOOL

(76) Inventor: Thomas John Method, 338 Summer St. #1, Franklin, MA (US) 02038

( * ) Notice: Subject to any disclaimer, the term of this patent is extended or adjusted under 35 U.S.C. 154(b) by 0 days.

(21) Appl. No.: 09/800,818

(22) Filed: Mar. 7, 2001

Related U.S. Application Data

(63) Continuation of application No. 09/617,703, filed on Jul. 17, 2000, now Pat. No. 6,226,825.
(60) Provisional application No. 60/144,211, filed on Jul. 19, 1999.

(51) Int. Cl.[7] ..... B25F 1/00
(52) U.S. Cl. ..... 7/164; 473/1; 473/451; 473/522
(58) Field of Search ..... 30/494; D21/232; 7/164, 170; 473/1, 37; 451/555, 552

(56) References Cited

U.S. PATENT DOCUMENTS 4,594,782 A 6/1986 Willard ..... 30/494
5,104,122 A 4/1992 Gossman ..... 273/18
D332,814 S 1/1993 Gossman ..... D21/232
5,228,160 A 7/1993 Porper ..... 7/158

OTHER PUBLICATIONS

Printout from Website: http://www.mastercue.com dated Aug. 2, 2000 Nine (9) pages.

*Primary Examiner*—D. S. Meislin
(74) *Attorney, Agent, or Firm*—Ronald R. Kilponen

(57) ABSTRACT

A multi-function pool cue tool is shown. The tool has a three sided open channel design. One side of the tool has an abrasive material attached for flattening tips. The center piece has two different sized indentations for contouring different sized tips on cues. The center piece also has a contour gauge associated with each of the indentations for checking the roundness of the tips after dressing of the tip in the indentations. The second side of the tool has a knurled surface for knurling the surface of the flat tip. A pair of wheels interconnect the first and second sides of the tool and have a diameter that varies to a minimum midway between the sides, the wheels for knurling the rounded tips on cues.

13 Claims, 3 Drawing Sheets

POOL CUE MULTI-FUNCTION TIP TOOL

CROSS REFERENCE TO PRIOR APPLICATIONS

This application is a continuation of patent application Ser. No. 09/617,703 filed Jul. 17, 2000, now U.S. Pat. No. 6,226,825, and claims benefit of Ser. No. 60/144,211, filed Jul. 14, 1999.

FIELD

The present version of this invention relates generally to the field of tools used to dress, adjust, measure and conform the tips of pool cues to a users preference.

BACKGROUND

This invention relates to tools for dressing, adjusting, measuring and conforming a pool cue tip to a users preference, and more particularly to a handy compact tool for preparing a pool cue tip for play.

Pool players use cues to play and many players have their own cues with which they play pool. Some cues are heavier or lighter and can have larger or smaller diameter shafts depending on a user's preference.

How the tip of the cue is dressed or adjusted plays a big part in how the force from the cue is transferred to the ball. Break shots may require a flat tip, while others may require a rounded tip. The shape of the tip affects what type of spin a player can put on a ball. A different type of spin is needed depending on the type of shot. Good pool requires a player to make an infinite number of shots under a large number of conditions and angles. The tip must be adjusted or shaped differently to hold chalk and to perform these different type of shots successfully. The adjusting to the tip must be done quickly and discreetly. The ability to discreetly and quickly dress a pool cue tip with a single tool is what makes this Pool Cue Tool so helpful, practical and useful.

This tool combines many of the features that pool players need in adjusting the tips of their cues. Instead of carrying many different tools, this device combines several tools into a compact portable package. A pool player can dress or adjust his/her tip easily with one compact multi-purpose tool and hence theoretically, improve his/her shot and ultimately his/her game.

For the foregoing reasons, there is a need for a multi-purpose compact Pool Cue Tool.

OBJECTS

A first object of this embodiment of the invention is to provide a compact tool for adjusting the tip of a pool cue.

Another object of this embodiment of the invention is to provide a tool to perform many of the most frequent adjustments to the tip of a pool cue.

It is yet another object of this embodiment of the invention to provide a tool that is compact and portable, eliminating a bulky set of tip adjustment tools.

It is a still further object of this embodiment of the invention to provide a tool that is aesthetically pleasing, durable and functional.

A final object of this embodiment of the invention is to provide a tool that is cost effective to manufacture.

These together with other objects of this invention, along with various features of novelty which characterize this invention, are pointed out with particularity in the claims annexed hereto and forming a part of this disclosure. For a better understanding of this invention, its operating advantages and the specific objects attained by its uses, reference should be had to the accompanying drawings and descriptive matter in which there is illustrated a preferred embodiment of this version of the invention.

DETAILED DESCRIPTION OF THE PREFERRED EMBODIMENTS

Figure 2:
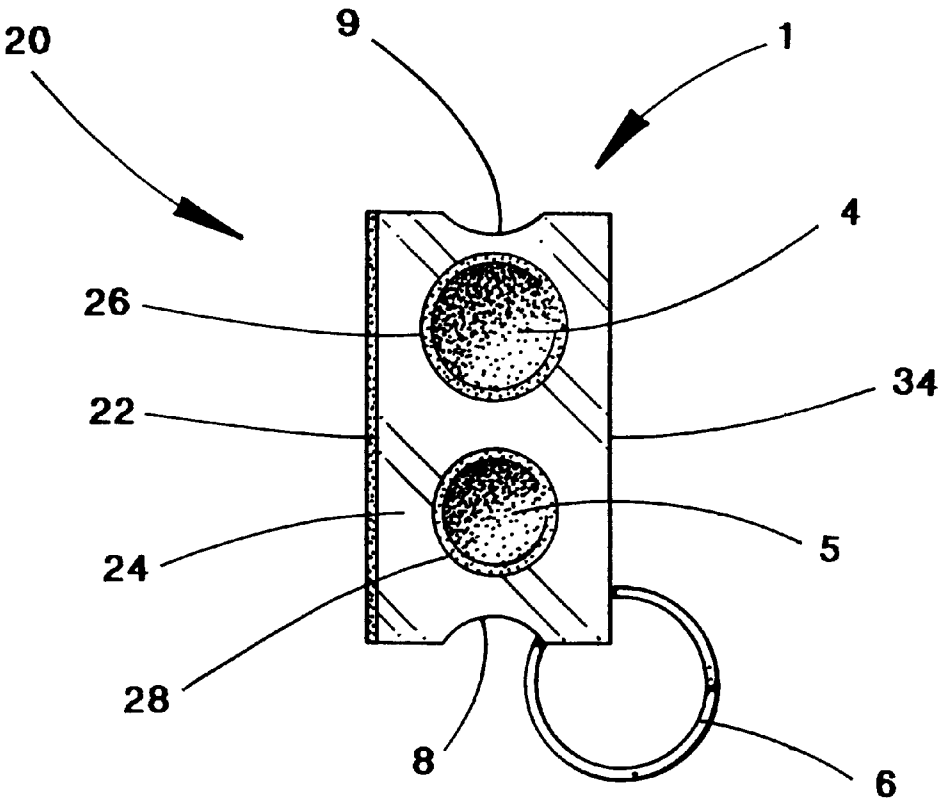
FIG. 2 shows a top view of one embodiment of the tip dressing tool.
Figure 1:
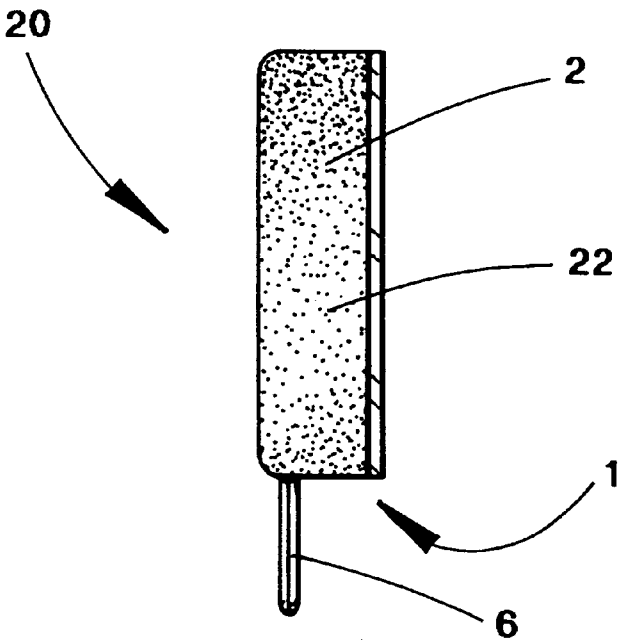
FIG. 1 shows a side view of one embodiment of the tip dressing tool.

Referring to the drawings in detail wherein like elements are indicated by like numerals, there is shown in FIGS. 1–6 a tool 20 for dressing the tips of pool cues.

Figure 4:
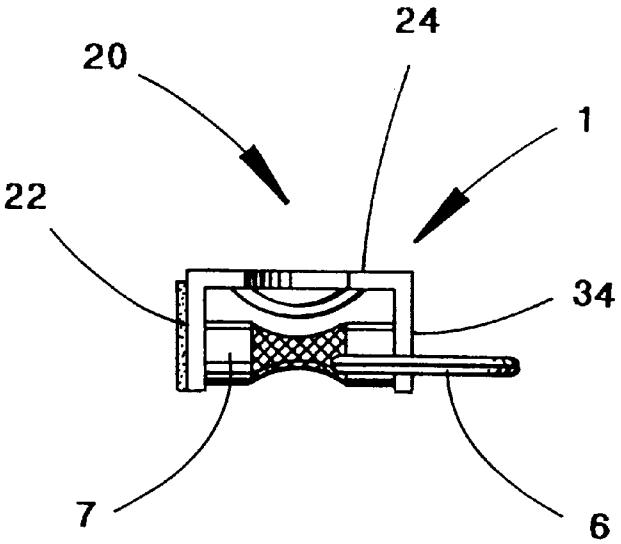
FIG. 4 shows an end view of one embodiment of the tip dressing tool.

The tool 20 has a channel shaped casing 1 with 3 sides, FIG. 4. The casing 1 in a preferred embodiment is cast from brass. The first side 22 has upon the exterior an abrasive strip 2, FIG. 1.

The abrasive strip 2 can be made from any type of abrasive materials commonly known in the art and attached to the first side 22. The preferred embodiment utilizes a general purpose anti-slip material such as 3M Safety Walk Anti-Slip material. The abrasive strip 2 is mounted on a pressure sensitive backing and placed on the first side 22. If the abrasive strip 2 should wear out, it can be removed and replaced. The abrasive strip 2 can be used to shape the tip flat primarily for the break shot.

Figure 3:
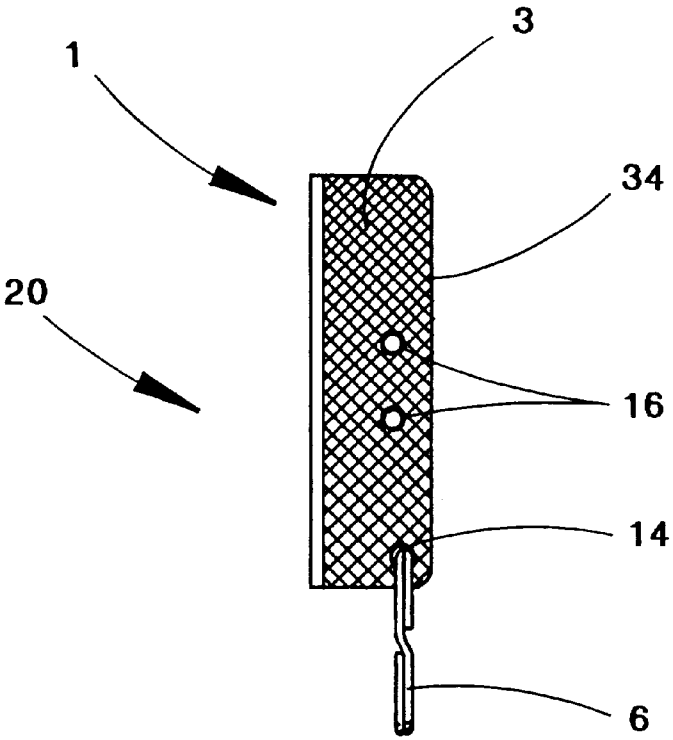
FIG. 3 shows a view of one embodiment the other side of the tip dressing tool.
Figure 6:
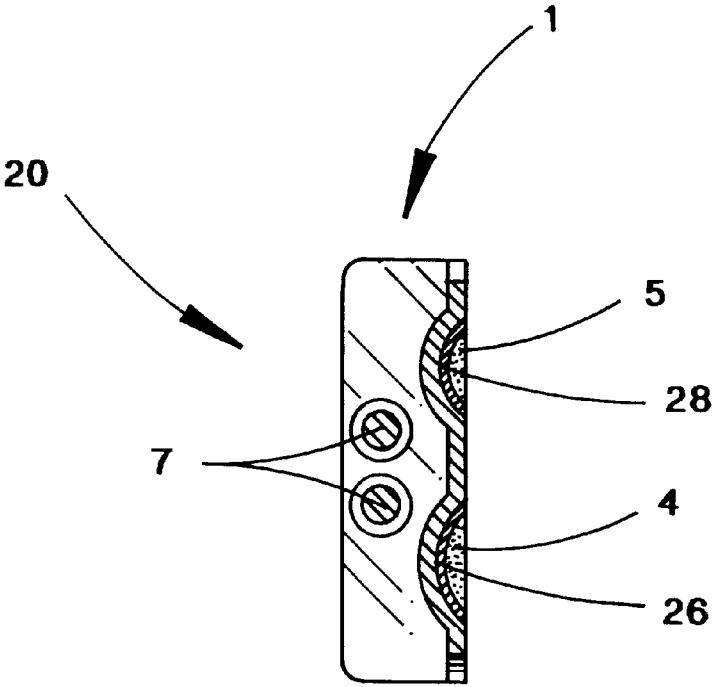
FIG. 6 is a cross sectional view of one embodiment along A—A in FIG. 5.
Figure 5:
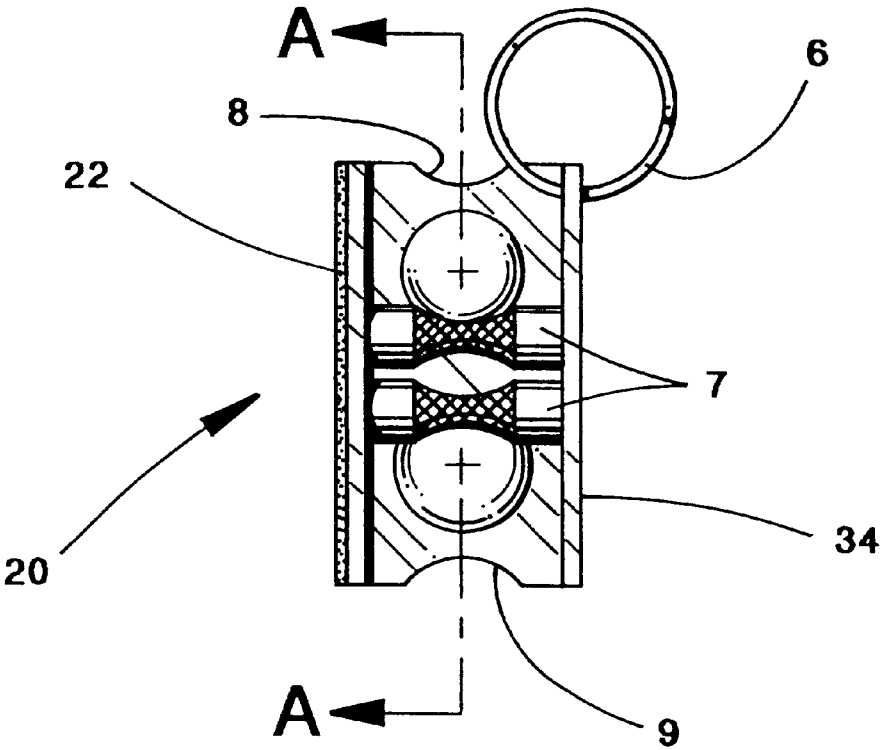
FIG. 5 is a bottom view of one embodiment of the tip dressing tool.

Once the tip is flattened with the abrasive strip 2, the knurled surface 3 on the second side 34 can be pressed onto the flat end of the tip creating indentations in the tip, FIG. 3. The indentations can then be chalked with a chalk block (not shown) where the chalk becomes impregnated into the indentations.

The first side 22 is connected to a center piece 24, FIG. 4. The center piece 24 can have one or more concave spherical indentations corresponding in size to common pool cue tips. A preferred embodiment has first indentation 26 and second indentation 28 which is smaller than first indentation 26, FIG. 2. The first indentation 26 has an abrasive insert 4 which is fastened to the inner surface of the first indentation 26, FIG. 2. The second indentation 28 has an abrasive insert 5 which is fastened to the inner surface of the second indentation 28, FIG. 2. The preferred embodiment utilizes a general purpose anti-slip material such as 3M Safety Walk Anti-Slip Material. The abrasive inserts 4,5 are mounted on a pressure sensitive adhesive backing and placed in the first and second indentation 26,28. If the abrasive inserts 4, 5 should wear out, they can be easily replaced with replacement inserts. Center piece 24 can also have nickel contour gauge 9 corresponding in size to the first indentation 26 and dime contour gauge 8 corresponding in size to the second indentation 28.

The abrasive insert 4 in the first indentation 26 and the abrasive insert 5 in the second indentation 28 can be used to abrade the tip of the cue into a rounded shape by turning the tip inside the appropriately sized indentation 26, 28. As the user is turning the tip in the first or second indentation 26, 28, the contour of the tip can be checked by aligning the tip with the appropriate contour gauge 8, 9. Depending on the results of the visual inspection, the user can abrade the tip more in the first or second indentation 26, 28 or use the cue to play.

The second side 34 is attached to the center piece 24, opposite and approximately parallel to the first side 22, FIG. 4. Second side 34 has a knurled surface 3. A carrying ring 6 may be attached through a ring hole 14 in the second side 28, FIG. 3.

Extending between the first side 22 and the second side 34 are at least two knurled textured wheels 7. The wheels 7, have a larger diameter where they are attached to the first and second sides 22, 34 and taper as they approach a mid point between the first and second sides 22, 34, FIG. 5. The wheels 7 in a preferred embodiment, are machined from aluminum, knurled and hardened. The wheels 7 are attached to the first side 22 and the second side 34 in wheel holes 16 in the first side 22 (not shown) and second side 34, FIG. 3. The wheel holes provide a rotational fixture such that the wheels 7 can rotate relative to the casing 1. The wheels 7 are used to roll over a rounded tip creating indentations in the tip. The indentations can then be chalked with a chalk block (not shown) where the chalk becomes impregnated into the indentations.

It will now be apparent to those skilled in the art that other embodiments, improvements, details and uses can be made consistent with the letter and spirit of the foregoing disclosure and within the scope of this patent, which is limited only by the following claims, construed in accordance with the patent law, including the doctrine of equivalents.

I claim:

1. A tool for shaping the tip of a cue, the tool comprising:

a casing having a first side and a second side and at least one indentation, the indentation located between the first side and second side;

at least one wheel mounted within the casing between the first side and second side, the wheel having a knurled surface; and where the wheel rotates within the casing to engage the tip of the cue.

2. The tool of claim 1, wherein:

the wheel tapers between a first end and a middle and between a second end and the middle, where the diameter of the first and second ends are larger than the diameter of the middle.

3. The tool of claim 1, further comprising:

the casing has a ring hole for attachment of a carrying ring.

4. A tool for shaping the tip of a cue, the tool comprising:

a casing having a first side and a second side and at least one wheel located there between, the wheel rotatable within the casing;

the casing having at least one indentation, the indentation located between the first side and second side and at least one indentation having an abrasive surface;

where the wheel and abrasive surface can be used to separately abrade the tip of a cue.

5. The tool of claim 4, wherein:

the diameter of the wheel at each end is larger than the diameter of the wheel between the ends.

6. The tool of claim 4, wherein:

the wheel has a knurled surface.

7. The tool of claim 4, further comprising:

a ring hole in the casing.

8. A tool for shaping the tip of a pool cue, the tool comprising:

a casing; and at least a first wheel with a first end and a second end wherein the first wheel is rotatably coupled to the casing and wherein the first wheel is tapered between the first and second ends of the first wheel to define a concave arcuate portion between the first and second ends of the first wheel;

whereby the first wheel can engage the tip of the pool cue and rotate therewith when the tip of the pool cue and the casing are moved relative to one another.

9. The tool of claim 8 wherein the concave arcuate portion of the first wheel is textured.

10. The tool of claim 9 wherein the concave arcuate portion is knurled.

11. The tool of claim 8 further comprising a second wheel rotatably coupled to the casing wherein the second wheel is tapered between the first and second ends of the wheel to define a concave arcuate portion between the first and second ends of the wheel whereby the first and second wheels can engage the tip of the pool cue and rotate therewith when the tip of the pool cue and the casing are moved relative to one another.

12. The tool of claim 11 wherein the first and second wheels have axes of rotation that are generally parallel.

13. The tool of claim 12 wherein the concave arcuate portion of the second wheel is knurled.

* * * * *